US009796542B2

(12) United States Patent
Shiohara et al.

(10) Patent No.: US 9,796,542 B2
(45) Date of Patent: Oct. 24, 2017

(54) SHEET FEEDING DEVICE AND IMAGE FORMING APPARATUS EMPLOYING THE SAME

(71) Applicant: Brother Kogyo Kabushiki Kaisha, Nagoya-shi, Aichi-ken (JP)

(72) Inventors: Yukio Shiohara, Nagoya (JP); Yohei Hashimoto, Nagakute (JP); Masamitsu Ukai, Nagoya (JP); Hirotaka Mori, Nagoya (JP); Noriyuki Kawamata, Nagoya (JP); Masahito Saeki, Nagoya (JP); Hiroyuki Okuchi, Nagoya (JP); Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/082,234

(22) Filed: Mar. 28, 2016

(65) Prior Publication Data

US 2016/0279974 A1 Sep. 29, 2016

(30) Foreign Application Priority Data

Mar. 26, 2015 (JP) ..... 2015-064372

(51) Int. Cl.
*B65H 1/26* (2006.01)
*B65H 7/04* (2006.01)
*B65H 3/06* (2006.01)

(52) U.S. Cl.
CPC ..... *B65H 1/266* (2013.01); *B65H 3/0684* (2013.01); *B65H 7/04* (2013.01);
(Continued)

(58) Field of Classification Search
CPC ..... B65H 1/266; B65H 2402/5155; B65H 2402/64; B65H 2405/113; B65H 2405/121; B65H 3/0684
See application file for complete search history.

(56) References Cited

U.S. PATENT DOCUMENTS 5,232,214 A * 8/1993 Matsuura ..... B65H 1/04 271/121
5,419,544 A * 5/1995 Ono ..... B65H 1/04 271/157

(Continued)

FOREIGN PATENT DOCUMENTS

JP 2000-177855 A 6/2000
JP 2000-313533 A 11/2000

*Primary Examiner* — Patrick Cicchino
(74) *Attorney, Agent, or Firm* — Banner & Witcoff, Ltd.

(57) ABSTRACT

A sheet feeding device having sheet feed tray configured to support multiple sheets be movably inserted to a main body. A sheet feed roller is configured to contact the sheet supported by the sheet feed tray and rotate to apply a feeding force to feed the sheet in a sheet feed direction. The sheet feed roller is configured to contact the sheet feed tray when there is no sheet on the sheet feed tray. A push latch mechanism is arranged on a downstream side with respect to the sheet feed roller in the sheet feed direction. A state of the push latch mechanism is alternately switched between an engaged state and a disengaged state every time when a pressing force is applied to the push latch mechanism. A first spring is configured to exert an elastic force to move the sheet feed tray toward a near side.

9 Claims, 5 Drawing Sheets

(52) U.S. Cl.
CPC .. *B65H 2402/5155* (2013.01); *B65H 2402/64* (2013.01); *B65H 2405/113* (2013.01); *B65H 2405/1136* (2013.01); *B65H 2511/22* (2013.01); *B65H 2511/515* (2013.01); *B65H 2601/322* (2013.01)

(56) References Cited

U.S. PATENT DOCUMENTS

| | | | | |
|---|---|---|---|---|
| 5,501,444 | A * | 3/1996 | Yukimachi | B65H 1/14 271/10.11 |
| 6,244,588 | B1 | 6/2001 | Tsubakimoto et al. | |
| 7,469,892 | B2 * | 12/2008 | Iwase | G03G 15/6502 271/145 |
| 8,002,269 | B2 * | 8/2011 | Asada | B65H 1/04 271/145 |
| 8,509,673 | B2 * | 8/2013 | Seto | B65H 1/266 271/9.08 |
| 8,608,154 | B2 * | 12/2013 | Yamada | G03G 15/6502 271/164 |
| 8,899,576 | B2 * | 12/2014 | Doshida | B65H 1/266 271/145 |
| 9,061,851 | B2 * | 6/2015 | Ikeda | B65H 1/266 |
| 9,104,161 | B2 * | 8/2015 | Hori | G03G 15/6505 |
| 9,126,788 | B2 * | 9/2015 | Ishikura | B65H 9/08 |
| 9,415,958 | B2 * | 8/2016 | Kubota | B65H 1/266 |
| 2008/0180764 | A1 * | 7/2008 | Wakiyama | B65H 1/266 358/498 |
| 2016/0289020 | A1 * | 10/2016 | Hayakawa | B65H 3/0684 |
| 2016/0347094 | A1 * | 12/2016 | Nihei | B41J 13/0009 |

* cited by examiner

SHEET FEEDING DEVICE AND IMAGE FORMING APPARATUS EMPLOYING THE SAME

This application claims priority under 35 U.S.C. §119 from Japanese Patent Application No. 2015-064372 filed on Mar. 26, 2015. The entire subject matter of the application is incorporated herein by reference.

BACKGROUND

Technical Field

The present disclosures relate to a sheet feeding device and image forming apparatus provided with the sheet feeding device.

Conventionally, a sheet feed tray which is provided with a mechanism to move with respect to a main body of an image forming apparatus when there is no sheet on the sheet feed tray has been known.

SUMMARY

In the conventional mechanism mentioned above, the sheet feed tray is moved with respect to the main body of the image forming apparatus making use of a rotational force of a sheet feed roller. In such conventional mechanism, the sheet feed tray is moved in a direction same as a sheet feeding direction.

Therefore, the conventional mechanism described above cannot be applied to the sheet feeding device in which a downstream side in the sheet feeding direction is a far side of the image forming apparatus. In consideration of the above, aspects of the disclosures provide an improved sheet feeding device in which the sheet feed tray can be moved to a near side when there becomes no sheet on the sheet feed tray in an image forming apparatus in which the sheet is fed from the near side to the far side of the main body of the image forming apparatus.

According to aspects of the disclosures, there is provided a sheet feeding device for a main apparatus (e.g., an image forming apparatus) which is configured to feed multiple sheets one by one. The sheet feeding device has a sheet feed tray configured to support multiple sheets thereon, the sheet feed tray being configured to be movably inserted to a main body, a sheet feed roller configured to contact the sheet placed on the sheet feed tray and rotate to apply a feeding force to the sheet to feed the sheet in a sheet feed direction, the sheet feed roller being configured to contact the sheet feed tray and rotate when there is no sheet in the sheet feed tray, a push latch mechanism arranged on a downstream side with respect to the sheet feed roller, in the sheet feed direction, a state of the push latch mechanism being alternately switched between an engaged state and a disengaged state every time when a pressing force is applied to the push latch mechanism, the engaged state being a state where push latch mechanism engages with an engaged part provided to the sheet feed tray, the disengaged state being a state where engagement between the push latch mechanism and the engaged part is released, and a first spring configured to exert an elastic force to move the sheet feed tray toward a near side which is an upstream side in the sheet feed direction.

According to aspects of the disclosures, there is provided an image forming apparatus, which is provided with an image forming device configured to form an image on a sheet, a sheet feeding device configured to feed multiple sheets toward the image forming device one by one, a sheet feed tray on which the multiple sheets are to be placed, the sheet feed tray being movably inserted to the image forming apparatus, a sheet feed roller configured to contact the sheet supported by the sheet feed tray and rotate to apply a feeding force to the sheet to feed the sheet in a sheet feed direction, the sheet feed roller being configured to contact the sheet feed tray and rotate when there is no sheet in the sheet feed tray, a push latch mechanism arranged on a downstream side, with respect to the sheet feed roller, in the sheet feed direction, a state of the push latch mechanism being alternately switched between an engaged state and a disengaged state every time when a pressing force is applied to the push latch mechanism, the engaged state being a state where push latch mechanism engages with an engaged part provided to the sheet feed tray, the disengaged state being a state where engagement between the push latch mechanism and the engaged part is released, and a first spring configured to exert an elastic force to move the sheet feed tray toward a near side which is an upstream side in the sheet feed direction.

BRIEF DESCRIPTION OF THE ACCOMPANYING DRAWINGS

FIG. 1 a cross-sectional side view of an image forming apparatus according to an illustrative embodiment.

DESCRIPTION OF THE ILLUSTRATIVE EMBODIMENTS

Figure 1:
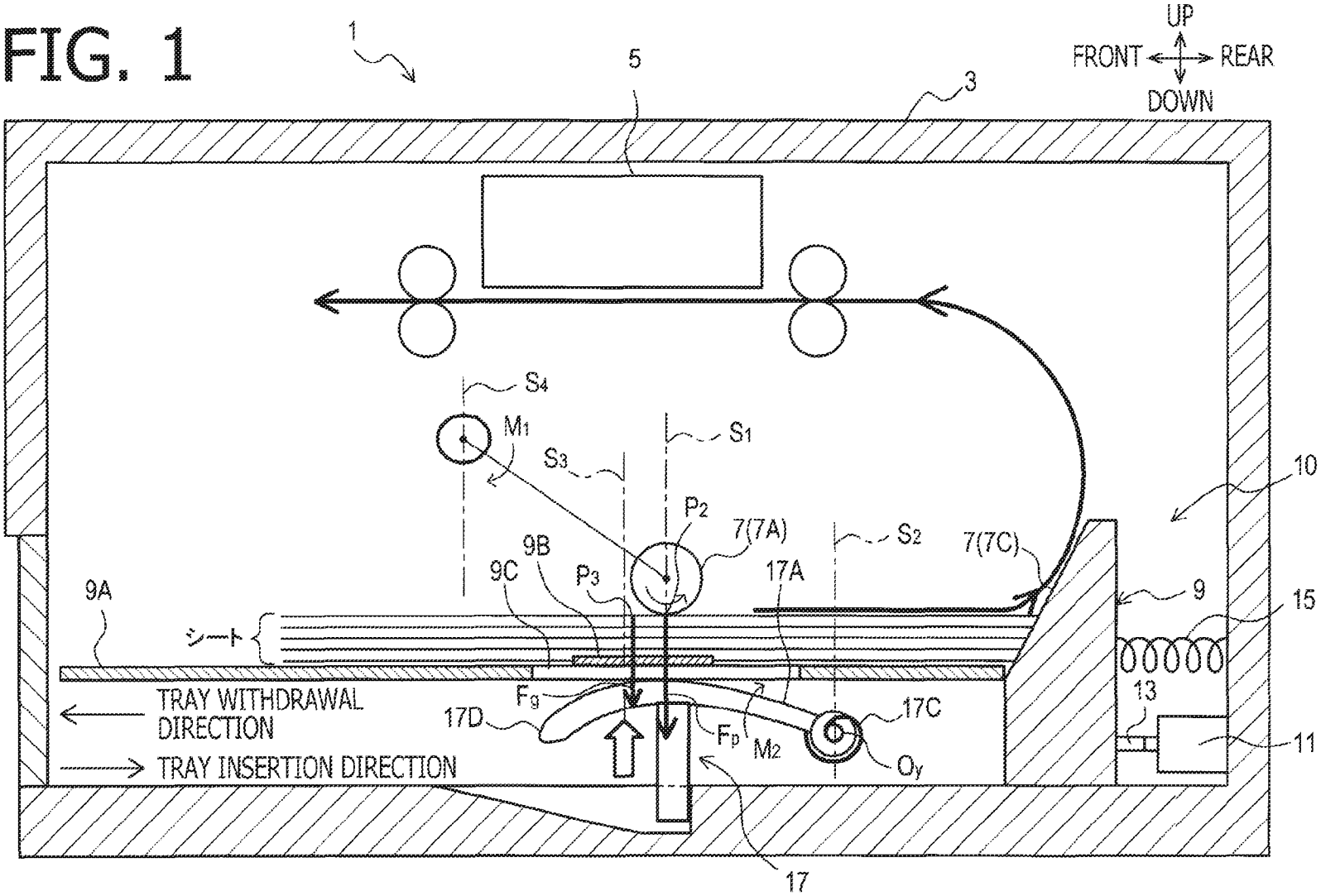

It is noted that in the following description describes only an illustrative embodiment. That is, aspects of the disclosures should not be limited to a particular configuration, mechanism, structure and the like described below.

It is noted that arrows indicating respective directions shown in drawings are mainly intended to clarify a positional relationship of respective drawings, and are not intended to limit position/orientation of the image forming apparatus, sheet feed device, and the like.

It is further noted that each of a member, a portion and the like, which are assigned with reference numbers and described should be regarded that $^{at}$ least one of the same is provided.

Hereinafter, referring to the drawings, illustrative embodiments of the disclosures will be described.

<First Embodiment>

1. Configuration of Image Forming Apparatus

In a casing 3 of an image forming apparatus 1, an image forming device 5 is accommodated as shown in FIG. 1. The image forming device 5 is configured to form an image on a printing sheet. According to the illustrative embodiment, the image forming device 5 employs an inkjet printing method, which is known as a method ejecting minute ink drops on the printing sheet to form an image.

On an upstream side with respect to the image forming device 5, a feeder mechanism 7 is arranged. The feeder mechanism 7 is configured to feed the printing sheets placed on a sheet feed tray 9 toward the image forming device 5 one by one. A sheet feeding device 10 according to the illustrative embodiment has the feeder mechanism 7 and the sheet feed tray 9.

The sheet feed tray 9 is configured such that more than one sheet can be placed thereon, and removably (withdrawably) attached (inserted) with respect to the main body of the image forming apparatus 1. Because of the removable configuration, the user can insert or withdraw the sheet feed tray 9 with respect to the main body of the image forming apparatus 1 when a user refills the sheet feed tray 9 with the printing sheets and/or when the user replaces the printing sheets accommodated in the sheet feed tray 9. It is noted that the term "main body" of the image forming apparatus 1 is intended to indicate the casing of the image forming apparatus 1 accommodating the image forming device 5.

2. Sheet Feeding Device 2.1 Feeder Mechanism

The feeder mechanism 7 has a sheet feed roller 7A, a roller arm 7B and an inclined wall 7C. The sheet feed roller 7A and the roller arm 7B are secured to the main body of the image forming apparatus 1, while the inclined wall 7C is provided to the sheet feed tray 9.

The sheet feed roller 7A is contacts the uppermost one, in a stacking direction (i.e., a vertical direction), of the one or more printing sheets stacked on the sheet feed tray 9, and rotates to apply a rotating force (i.e., a sheet feeding force) to the uppermost printing sheet.

In FIG. 1, the sheet feed roller 7A rotates counterclockwise. Therefore, the printing sheet which receives the sheet feeding force from the sheet feed roller 7A is fed from a front side toward a rear side. It is noted that an outer circumferential surface of the sheet feed roller 7A is formed of material having a relatively high friction coefficient such as rubber.

The sheet feed roller 7A applies the feeding force to the printing sheet for a particular period from start of feeding the printing sheet till the printing sheet is nipped by conveying rollers (not shown) which are arranged on a downstream side, in the sheet feed direction, with respect to the feeder mechanism 7. Thereafter, transmission of the driving force to the sheet feed roller 7A is terminated. Therefore, the sheet feed roller 7A is driven by the printing sheet to rotate as the printing sheet proceeds.

The sheet feed roller 7A changes its position toward a sheet placement plate 9A of the sheet feed tray 9 as the number of printing sheets supported by the sheet feed tray 9 is reduced. According to the illustrative embodiment, a rotation shaft of the sheet feed roller 7A is supported at a tip end portion of the roller arm 7B. The roller arm 7B is attached to the main body of the image forming apparatus 1 such that a base portion thereof is rotatably supported by the main body.

That is, the sheet feed roller 7A is attached to the main body via the roller arm 7B so as to be rotatable with respect to the main body. With this configuration, as the number of the printing sheets placed on the sheet feed tray 9 is reduces, the sheet feed roller 7A moves toward the sheet placement plate 9A.

When there is no printing sheet on the sheet feed tray 9, the sheet feed roller 7A contacts the sheet feed tray 9. It is noted that a portion of the sheet feed tray 9 which contacts the sheet feed roller 7A when there is no printing sheet on the sheet feed tray 9, a resistance plate 9B is provided.

Figure 2:
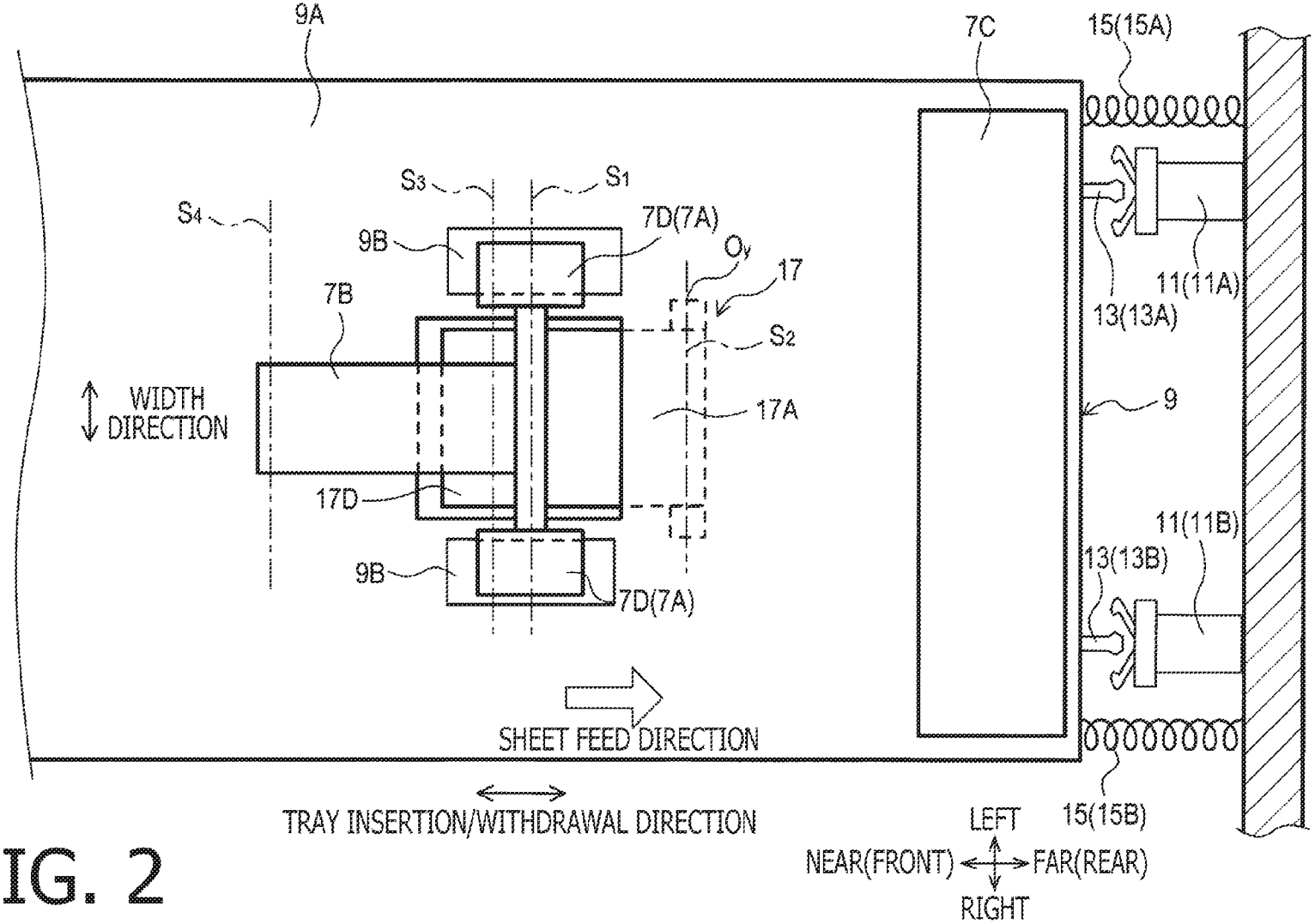
FIG. 2 is a plan view of a sheet feed tray according to the illustrative embodiment of the disclosures.

According to the illustrative embodiment, the sheet feed roller 7A has two roller portions 7D, each configured to contact the printing sheet, at one and the other ends in a width direction as sown in FIG. 2. To the two roller portions 7D, a rotational force is transmitted through a not-shown gear train. It is noted that the width direction is a direction orthogonal to a sheet feed direction, and parallel with a plane of the printing sheets supported by the sheet feed tray 9. Therefore, according to the illustrative embodiment, the width direction coincides with a right-left direction of the image forming apparatus 1.

The inclined wall 7C serves as a so-called "bank separation part." That is, when two or more printing sheets are fed by the sheet feed roller 7A, the inclined wall 7C shifts leading ends of the multiple printing sheets in the feeding direction so as to be aligned along the inclined wall 7C, and further applies feeding resisting force to the printing sheet other than the uppermost printing sheet.

Because of the above configuration, even if two or more printing sheets are fed by the sheet feed roller 7A from the sheet feed tray 9, only the uppermost printing sheet to which the feeding force is directly applied by the sheet feed roller 7A proceeds, while the other printing sheets are remained in the sheet feed tray 9.

A center Or1 of rotational movement of the roller arm 7B is located on a downstream side (i.e., a front side according to the illustrative embodiment), in the sheet feed direction, with respect to a center Or2 of rotational movement of the sheet feed roller 7A. In the following description, the downstream side in the sheet feed direction will also be referred to as a far side, while an upstream side in the sheet feed direction will also be referred to as a near side as indicated in FIG. 2. In other words, the front side and rear side indicated by arrows in FIG. 1 correspond to the near side and the far side, respectively.

2.2 Sheet Feed Tray

At the far side in the main body of the image forming apparatus 1, at least one push latch mechanism 11 is provided as shown in FIG. 2. According to the illustrative embodiment, multiple push latch mechanisms 11 (i.e., a first push latch mechanism 11A and a second push latch mechanism 11B) are provided.

The first push latch mechanism 11A is located at a position shifted on one end side (e.g., on the left side in the illustrative embodiment) with respect to the sheet feed roller 7A. The second push latch mechanism 11B is located at a position shifted on the other end side (e.g., on the right side in the illustrative embodiment) with respect to the sheet feed roller 7A. In the following description, the first push latch mechanism 11A and the second push latch mechanism 11B will be collectively referred to as a push latch mechanism 11.

The push lath mechanism 11 is configured such that an engaging state in which the push latch mechanisms 11 engage with engaged parts 13 provided to the sheet feed tray 9 and an disengaged state in which the push lath mechanisms 11 disengage with the engaged parts 13 every time the push latch mechanisms 11 receive pressing force. Such a mechanism is well-known as a push-latch mechanism. It is noted that, according to the illustrative embodiment, the term engaged part 13 is used as a collective term, and there are multiple engaged parts 13 (i.e., a first engaged part 13A and a second engaged part 13B in the illustrative embodiment) are provided.

Figure 3A:
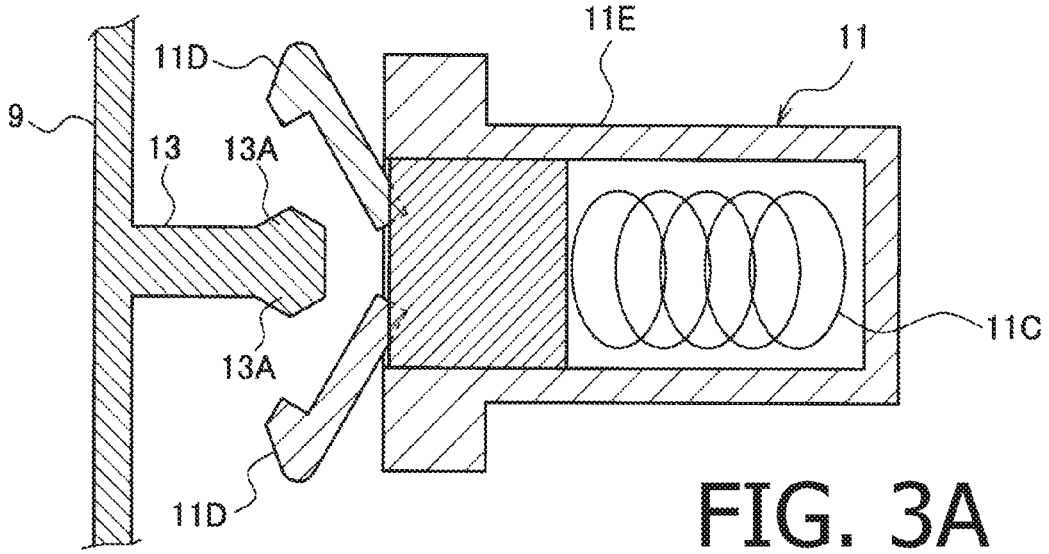
FIGS. 3A and 3B are cross-sectional side view of a push latch mechanism according to the illustrative embodiment of the disclosures.
Figure 3B:
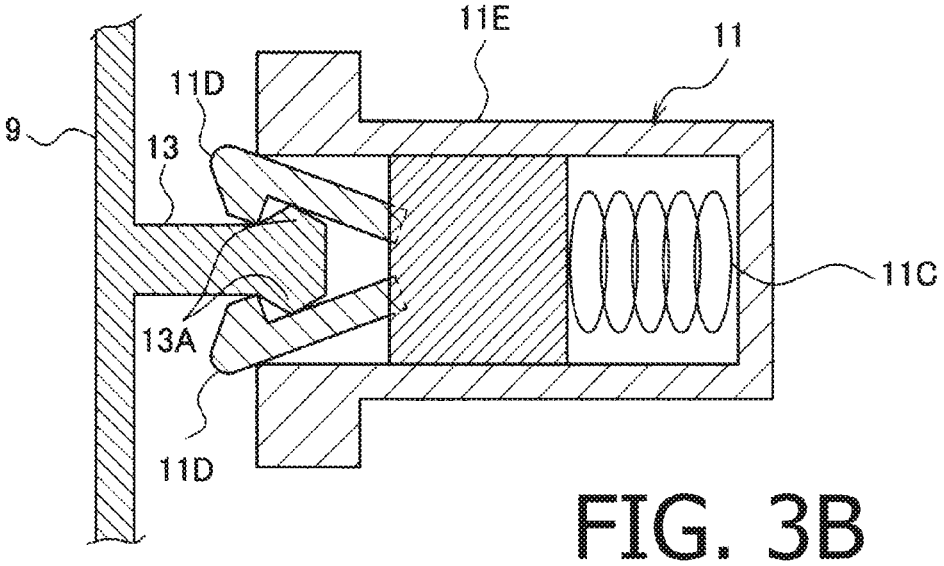

The push latch mechanism 11 (i.e., each of the push latch mechanism 11A and 11B) has a pair of engaging levers 11D, a casing 11E which accommodates the pair of engaging levers 11D so as to be protruded/retracted, and a first spring 11C, as shown in FIGS. 3A and 3B.

The engaged part 12 is provided at the far side of the sheet feed tray 9, or a sheet proceeding side of the sheet feed tray 9. The engaged part 13 is a protruded part which protrudes toward the push latch mechanism 11. At a tip end portion of the engaged part 13, an umbrella-shaped part 13A, which is tapered toward the push latch mechanism 11, is formed. The umbrella-shaped part 13A is to be engaged with the pair of engaging lever 11D.

When the pair of engaging levers 11D is accommodated in the casing 11E (see FIG. 3B), the pair of engaging levers 11D clamp the umbrella-shaped part 13A. That is, the pair of engaging levers 11D and the engaged part 13 are in the engaged state.

When the pair of engaging levers 11D protrudes from the casing 11E (see FIG. 3A), the engaged part 13 and the pair of engaging levers 11D are in the disengaged state. When the engaged part 13 in the engaged state is pushed toward the push latch mechanism 11, the push latch mechanism 11 is unlocked, the state of the engaging levers 11D changes from the engaged state to the disengaged state.

A first spring 11C exerts an elastic force which acts to move the sheet feed tray 9 to the near side (i.e., the front side). That is, the first spring 11C is assembled in the push latch mechanism 11 and is in a compressed state when the push lath mechanism 11 is in the engaged state.

Second springs 15 shown in FIG. 2 have elastic force to move the sheet feed tray 9 toward the near side. According to the illustrative embodiment, the second springs 15 are multiple sprints (i.e., springs 15A and 15B) which are arranged at different positions in the width direction. Similar to the terms "push latch mechanism" and "engaged part", the term "second spring" is used as a collective term for the multiple sprints (e.g., the springs 15A and 15B).

According to the illustrative embodiment, the first push latch mechanism 11A and the second push latch mechanism 11B, and the springs 15A and 15B, are arranged at symmetrical position in the width direction with respect to the center of the sheet feed tray 9. It is noted that the second springs 15 are assembled to the main body of the image forming apparatus 1.

Figure 4:
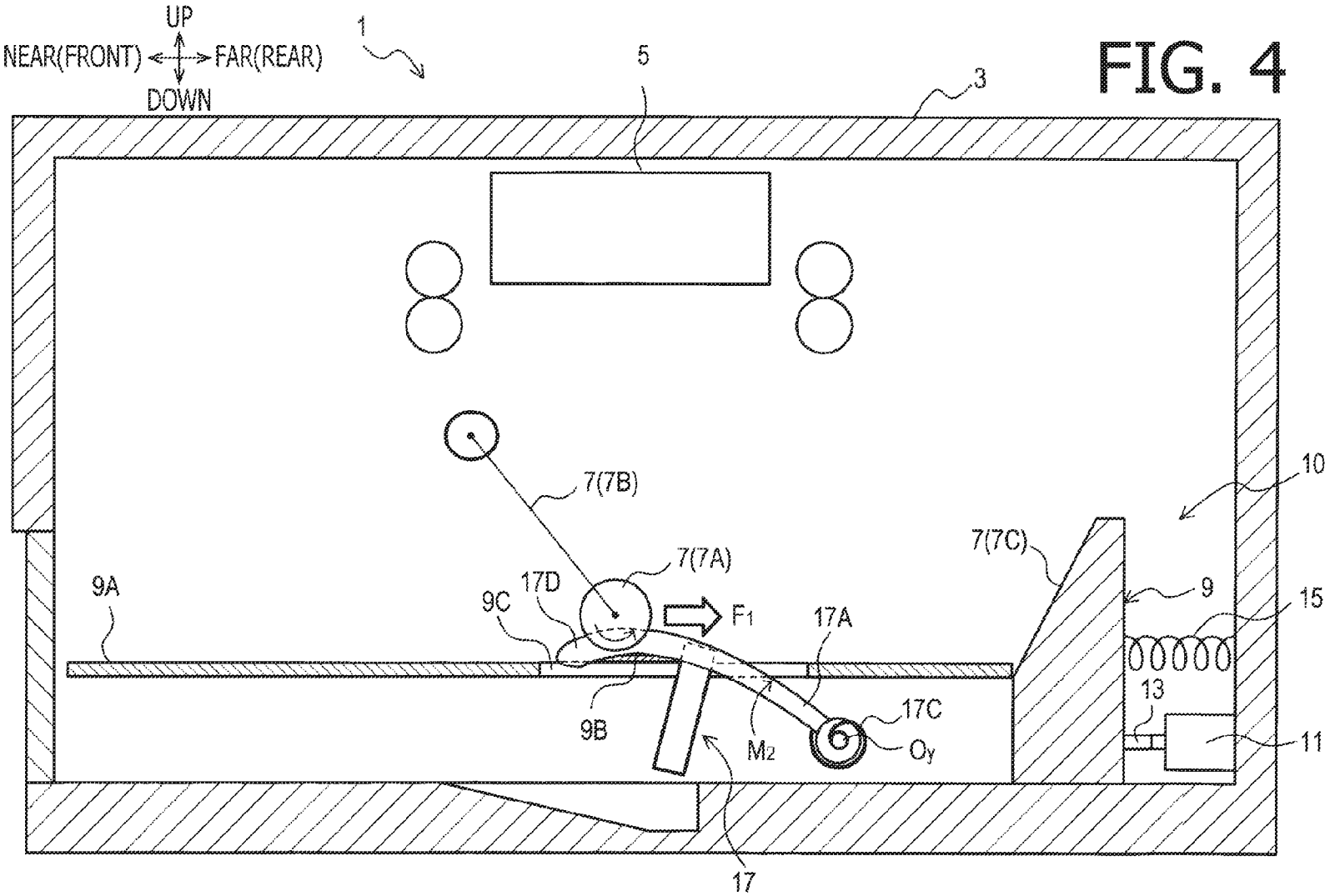
FIG. 4 is a cross-sectional side view of the image forming apparatus illustrating an operation of the sheet feeding device according to the illustrative embodiment of the disclosures.
Figure 5:
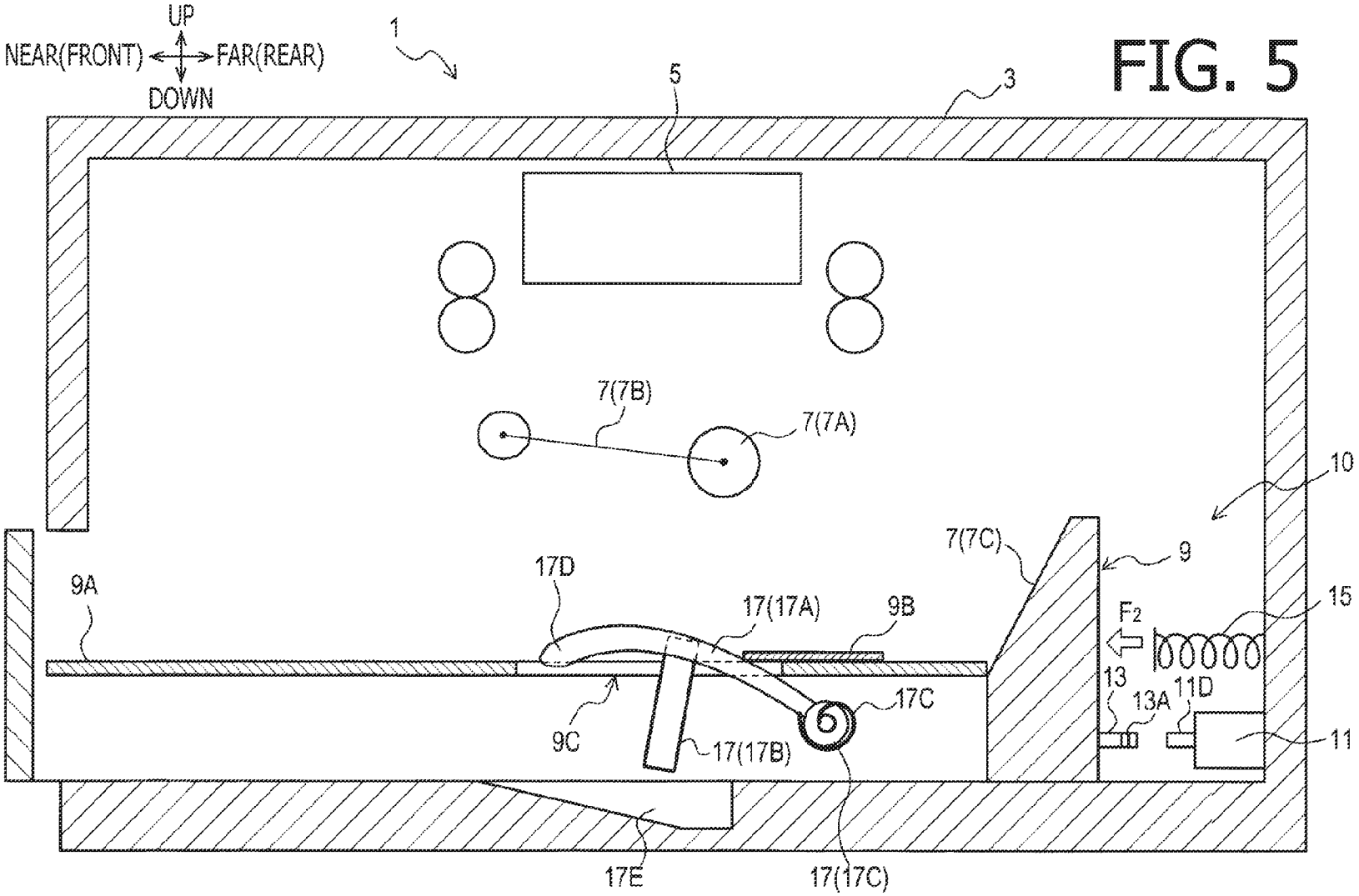
FIG. 5 is a cross-sectional side view of the image forming apparatus illustrating an operation of the sheet feeding device according to the illustrative embodiment of the disclosures.

Therefore, when there becomes no printing sheet on the sheet feed tray 9, the sheet feed tray 9 receives the rotational force of the sheet feed roller 7A and moved towards the push latch mechanism 11 with a pushing force of F1 as shown in FIG. 4. Then, the state of the push latch mechanism 11 changes from the engaged state to the disengaged state. As a result, as shown in FIG. 5, the sheet feed tray 9 moves to the front side by the elastic force (F2) of the first spring 11C.

2.3 Regulation Mechanism

<Configuration of Regulation Mechanism>

The image forming apparatus 1 is provided with a regulation mechanism 17 configured to regulate movable range of the sheet feed tray 9. The regulation mechanism 17 has a regulating state in which movement of the sheet feed tray 9 to the far side with respect to the main body of the image forming apparatus 1 is regulated (see FIG. 1) and a non-regulated state in which the above regulated state is released (see FIG. 5).

The regulating mechanism 17 is configured to maintain the regulating state with receiving a pressing force from the printing sheets placed on the sheet feed tray 9. As shown in FIG. 1, the regulating mechanism 17 is provided at a position shifted downward, in the vertical direction, with respect to the sheet feed roller 7A.

The regulation mechanism 17 maintains its regulating state making use of a pressing force including gravity acting on the printing sheets, a pressing force of the sheet feed roller 7A to press the printing sheet downward in the vertical direction, and the like.

According to the illustrative embodiment, the regulation mechanism 17 includes a rotatable arm 17A, an engaging protrusion 17B and a third spring 17C. The rotatable arm 17A contacts the lowermost sheet of the printing sheets placed on the sheet feed tray 9 and receives the pressing force therefrom. The rotatable arm 17A is configured to contact the lowermost sheet through an opening 9C which is formed on a sheet placement plate 9A as shown in FIG. 1.

A center Oy of the rotational movement of the rotatable arm 17A is located at a position on the far side with respect to a distal end 17D of the rotatable arm 17A as shown in FIG. 1. The rotatable arm 17A is a belt-shaped member extending toward the distal end 17D, and smoothly curves to form a convex form protruding toward the sheet feed tray 9. The convex shape of the rotatable arm 17A has an apex between the distal end 17D and the rotational center Oy.

The engaging protrusion 17B is a protrusion which moves in association with the rotatable arm 17A. When the pressing force is applied to the rotatable arm 17A, the engaging protrusion 17B engages with an engagement recess 17E formed on the main body of the image forming apparatus 1 so that the regulation mechanism 17 is in the regulating state (see FIG. 1).

The engaging protrusion 17B is a plate-like or rod-like member extending from the rotatable arm 17A toward the center Oz of curvature of the rotatable arm 17A (i.e., downwardly in the vertical direction). It is noted that the engaging protrusion 17B is integrally formed with the rotatable arm 17A, or secured to the rotatable arm 17A with welding or by screws, and moves in association with the rotatable arm 17A.

The third spring 17C exerts an elastic force to move the engaging protrusion 17B from the engagement recess 17E. According to the illustrative embodiment, the third spring 17C is a torsion coil spring. The third spring 17C is arranged at the rotational center Oy of the rotatable arm 17A and configured to apply the elastic force onto the rotatable arm 17A.

It is noted that a positional relationship among the sheet feed roller 7A, the roller arm 7B, the rotatable arm 17A and the like is required to satisfy the following condition (see FIGS. 1 and 2). That is, "a first vertical plane S1 including a roller contacting position P2" is located between "a second vertical plane S2 including an axis of the rotational center of the rotatable arm 17A" and "a third vertical plane S3 which includes an arm contacting position P3 and is parallel to the second vertical plane S2."

Further, "a fourth vertical plane S4 including an axis of the rotational center of the roller arm 7B" is located on an opposite side to the second vertical plane with the first vertical plane Si located therebetween. It is noted that the roller contacting position P2 is a position where the printing sheets placed on the sheet feed tray 9 and the sheet feed roller 7A contact each other. Further, the arm contacting position P3 is a position where the printing sheets placed on the sheet feed tray 9 and the rotatable arm 17A contact each other.

<Operation of Restriction Mechanism>

When there are printing sheets on the sheet feed tray 9, as shown in FIG. 1, the engaging protrusion 17B and the engagement recess 17E engage with each other by the pressing force. Accordingly, even if the sheet feed roller 7A applies a force in the sheet feeding direction (i.e., toward the far side) to the printing sheet, movement of the sheet feed tray 9 toward the far side (i.e., toward the push latch mechanism 11 side) is restricted.

When there becomes no printing sheets on the sheet feed tray 9, since the pressing force is removed, the rotatable arm 17A rotationally move upwards in the vertical direction by the elastic force of the third spring 13C (see FIG. 5), the engaging protrusion 17B is disengaged from the engagement recess 17E.

3. Characteristic Features of Sheet Feeding Device

According to the illustrative embodiment, when there becomes no printing sheets on the sheet feed tray 9, the engaging protrusion 17B, which was pressed by the printing sheets, rotationally moves upward, thereby the engaging protrusion 17B being disengaged from the engagement recess 17E.

When the image forming apparatus 1 receives a print instruction, the sheet feed roller 7A rotates with contacting the resistance plate 9B, which has larger friction than the printing sheet. As a result, the sheet feed tray 9 is pushed (F1), by the rotational force of the sheet feed roller 7A, toward the push latch mechanism 11.

At this time, the state of the push latch mechanism 11 is changed from the engaging state to the disengaged state. Since the sheet feed roller 7A stops a particular period later, pressing of the sheet feed tray 9 toward the push latch mechanism 11 is stopped after the rotation of the sheet feed roller 7A is stopped. Then, the sheet feed tray 9 moves toward the near side by the elastic force (F2) of the first spring 11C.

Accordingly, in the sheet feeding device which is configured that the sheet proceeding side is the far side, the sheet feed tray 9 can be moved toward near side when there becomes no sheet on the sheet feed tray 9.

Further, according to the illustrative embodiment, there is provided a second sprint 15 configured to exert an elastic force to move the sheet feed tray 9 toward the near side. With this configuration, it is ensured that the sheet feed tray 9 is moved toward the near side.

According to such a configuration, the user recognizes that there is no printing sheet on the sheet feed tray 9 simply by visually recognizing that the sheet feed tray 9 pops up toward the near side from the main body of the image forming apparatus 1 as shown in FIG. 5.

Further, when the sheet feed tray 9 pops up toward the near side, the push latch mechanism 11 is in the disengaged state. Therefore, the user can withdraw the sheet feed tray 9 for supplying new printing sheets without any resistances.

After the user supplies the new printing sheets on the sheet feed tray 9, the user is only required to insert the sheet feed tray 9 until the push latch mechanism 11 is in the engaged state. Since there is a click feed when the push latch mechanism 11 is in the engaged state, the user can recognize that the sheet feed tray 9 is attached to the casing 3 without fail.

According the illustrative embodiment, there is provided the restriction mechanism 17 which is capable of restricting movement of the sheet feed tray 9 toward the far side with respect to the main body of the image forming apparatus 1. With this configuration, it is possible to restrict that the sheet feed tray 9 is pressed toward the far side (i.e., the push latch mechanism 11 side) by error as the feeding force the sheet feed roller 7A applies to the printing sheet is transmitted, via the printing sheet, to the sheet feed tray 9.

According to the illustrative embodiment, as shown in FIG. 5, the first vertical plane S1 is located between the second vertical plane S2 and the third vertical plane S3. Because of this configuration, disengagement between the engaging protrusion 17B and the engagement recess 17E can be restricted when there is a sheet on the sheet feed tray 9.

It is noted that forces to maintain the engagement state between the engaging protrusion 17B and the engagement recess 17E, that is the forces counteract the third spring 17C include the gravity Fg caused by one or multiple printing sheets mounted on the sheet feed tray 9, and a pressing force Fp the sheet feed roller 7A presses the printing sheet(s) toward the sheet feed tray 9. In the following description, the gravity Fg and the force Fp are collectively referred to as a counteracting force.

The counteracting force is transmitted to the rotatable arm 17A through the printing sheet. Therefore, if the roller contacting position P2 and the arm contacting position P3 are excessively spaced from each other, the printing sheet may be folded and the counteracting force may not be transmitted to the rotatable arm 17A.

Thus, there is a possibility that the engaging protrusion 17B is separated from the engagement recess 17E and the engaged state is released (i.e., disengaged). In particular, the possibility of the disengagement becomes higher when the sheet feed tray 9 is inclined such that the far side is higher than the near side.

According to the illustrative embodiment, it is possible to prevent that the roller contacting position P2 and the arm contacting position P3 are spaced largely, it is possible to prevent disengagement between the engaging protrusion 17B and the engagement recess 17E as they are spaced largely from each other.

According to the illustrative embodiment, the fourth vertical plane S4 is located opposite to the second vertical plane S2 with the first vertical plane S1 located therebetween. With this configuration, according to the illustrative embodiment, the rotational force M1 acting on the roller arm 7B is a moment directed from the far side toward the near side. Further, the rotational force M2 acting on the rotatable arm 17A is a moment directed from the near side toward the far side.

Thus, the rotational force M1 acting on the roller arm 7B and the rotational force M2 acting on the rotatable arm 17A cancel each other. Further, it is also possible to restrict that the engaging protrusion 17B is moved away from the engagement recess 17E and finally disengaged.

<Other Embodiments>

In the above-described illustrative embodiment, there are two push latch mechanisms 11. Aspects of the disclosures need not be limited to such a configuration, and only one push latch mechanism 11, or more than two push latch mechanism 11 may be provided.

According to the above-described illustrative embodiment, the second sprint 15 and the restriction mechanism 17 are provided. Aspects of the disclosures need not be limited to such a configuration, and the second spring 15 and/or the restriction mechanism 17 may be omitted.

According to the above-described illustrative embodiment, an inkjet printer is employed as the image forming device. Aspect of the disclosures need not limited to such a configuration, and a printer employing an electrophotographic image forming method, of any other well-known image forming device can be used.

According to the above-described illustrative embodiment, the so-called bank separation part is employed. Aspects of the disclosures need not be limited to such a configuration, and the sheet feeding device may be configured to employ a separation pad method, a retard roller method and the like.

What is claimed is:

1. A sheet feeding device, comprising:

a sheet feed tray configured to support multiple sheets, the sheet feed tray being configured to be movably inserted to a main body;

a sheet feed roller configured to contact a sheet supported by the sheet feed tray and rotate to apply a feeding force to the sheet to feed the sheet in a sheet feed direction, the sheet feed roller being configured to contact the sheet feed tray and rotate when there is no sheet in the sheet feed tray;

a push latch mechanism arranged on a downstream side, with respect to the sheet feed roller, in the sheet feed direction, a state of the push latch mechanism being alternately switched between an engaged state and a disengaged state every time a pressing force is applied to the push latch mechanism, the engaged state being a state where the push latch mechanism engages with an engaged part provided to the sheet feed tray, the disengaged state being a state where engagement between the push latch mechanism and the engaged part is released;

a first spring configured to exert an elastic force to move the sheet feed tray toward a near side which is an upstream side of the sheet feeding device in the sheet feed direction; and a restriction mechanism configured to switch between a restricted state and a non-restricted state, the restricted state being a state where the sheet feed tray is restricted from moving toward a far side with respect to a main body of the sheet feeding device, the far side being a downstream side of the sheet feeding device in the sheet feed direction, the non-restricted state being a state where the restricted state is released, the restriction mechanism being configured to maintain the restricted state while a pressing force is received from the sheet placed on the sheet feed tray.

2. The sheet feeding device according to claim 1, wherein the first spring is assembled in the push latch mechanism.

3. The sheet feeding device according to claim 1, further comprising a second spring configured to exert an elastic force to move the sheet feed tray in the near side.

4. The sheet feeding device according to claim 1, wherein the restriction mechanism comprises:

a rotatable arm rotatably assembled to the sheet feed tray, the rotatable arm configured to contact a lowermost surface of the sheets supported on the sheet feed tray and to receive a pressing force from the sheets;

an engaging protrusion configured to move in association with the rotatable arm, the engaging protrusion engaging with an engaging recess formed on the main body when the pressing force acts on the rotatable arm; and a third spring configured to exert an elastic force to separate the engaging protrusion from the engaging recess.

5. The sheet feeding device according to claim 4, wherein a first vertical plane including a roller contacting position is located between a second vertical plane including an axis of a rotational center of the rotational arm and a third vertical plane including an arm contacting position and parallel to the second vertical plane, the roller contacting position being a position at which the sheet feed roller contacts the sheet supported by the sheet feed tray, the arm contacting position being a position at which the rotational arm contacts the sheets placed on the sheet feed tray.

6. The sheet feeding device according to claim 5, further comprising a roller arm configured to rotatably support a rotational shaft of the sheet feed roller, wherein a fourth vertical plane including an axis of the rotation center of the roller arm is located at a position opposite to the second vertical plane with the first vertical plane located therebetween.

7. The sheet feeding device according to claim 1, wherein the push latch mechanism includes at least a first push latch mechanism and a second push latch mechanism which are arranged in a width direction orthogonal to the feeding direction and parallel to a plane of the sheets supported by the sheet feed tray.

8. The sheet feeding device according to claim 7, wherein a location of the first push latch mechanism is shifted, in the width direction, from the sheet feed roller on one end side of the sheet feed roller, and a location of the second push latch mechanism is shifted, in the width direction, from the sheet feed roller on another end side of the sheet feed roller.

9. An image forming apparatus, comprising:

an image forming device configured to form an image on a sheet;

a sheet feeding device configured to feed multiple sheets toward the image forming device one by one;

a sheet feed tray configured to support the multiple sheets, the sheet feed tray being movably insertable into the image forming apparatus;

a sheet feed roller configured to contact the sheet supported by the sheet feed tray and rotate to apply a feeding force to the sheet to feed the sheet in a sheet feed direction, the sheet feed roller being configured to contact the sheet feed tray and rotate when there is no sheet in the sheet feed tray;

a push latch mechanism arranged on a downstream side, with respect to the sheet feed roller, in the sheet feed direction, a state of the push latch mechanism being alternately switched between an engaged state and a disengaged state every time a pressing force is applied to the push latch mechanism, the engaged state being a state where the push latch mechanism engages with an engaged part provided to the sheet feed tray, the disengaged state being a state where engagement between the push latch mechanism and the engaged part is released; and a first spring configured to exert an elastic force to move the sheet feed tray toward a near side which is an upstream side of the image forming apparatus in the sheet feed direction; and a restriction mechanism configured to switch between a restricted state and a non-restricted state, the restricted state being a state where the sheet feed tray is restricted from moving toward a far side with respect to a main body of the sheet feeding device, the far side being a downstream side of the image forming apparatus in the sheet feed direction, the non-restricted state being a state where the restricted state is released, the restriction mechanism being configured to maintain the restricted state while a pressing force is received from the sheet placed on the sheet feed tray.

* * * * *